US007013526B2

(12) United States Patent
Eskelinen et al.

(10) Patent No.: US 7,013,526 B2
(45) Date of Patent: Mar. 21, 2006

(54) EQUIPMENT AND METHOD FOR CHANGING A BLADE

(75) Inventors: Ilkka Eskelinen, Jyskä (FI); Ari Närhi, Kuopio (FI); Harri Ruotsalainen, Varkaus (FI)

(73) Assignee: Metso Paper, Inc., Helsinki (FI)

( * ) Notice: Subject to any disclaimer, the term of this patent is extended or adjusted under 35 U.S.C. 154(b) by 29 days.

(21) Appl. No.: 10/479,668

(22) PCT Filed: Jun. 4, 2002

(86) PCT No.: PCT/FI02/00477

§ 371 (c)(1),
(2), (4) Date: Dec. 4, 2003

(87) PCT Pub. No.: WO02/099189

PCT Pub. Date: Dec. 12, 2002

(65) Prior Publication Data

US 2004/0168279 A1 Sep. 2, 2004

(30) Foreign Application Priority Data

Jun. 5, 2001 (FI) ..... 20015006

(51) Int. Cl.
*B21B 45/02* (2006.01)
*D21G 3/00* (2006.01)
*B31F 1/14* (2006.01)

(52) U.S. Cl. ..... 15/256.53; 15/256.51; 162/281; 100/174

(58) Field of Classification Search ..... 15/256.51, 15/256.53; 162/272, 281, 199; 118/106, 118/257; 100/174
See application file for complete search history.

(56) References Cited

U.S. PATENT DOCUMENTS

| | | | | |
|---|---|---|---|---|
| 2,664,792 | A * | 1/1954 | Cook | 15/256.51 |
| 4,528,067 | A | 7/1985 | Hedberg | |
| 4,691,406 | A * | 9/1987 | Goodnow et al. | 15/256.53 |
| 5,138,740 | A | 8/1992 | Goodnow et al. | |
| 6,651,303 | B1 | 11/2003 | Toivanen et al. | |
| 6,830,659 | B1 * | 12/2004 | Sovijarvi | 162/263 |

FOREIGN PATENT DOCUMENTS

| | | |
|---|---|---|
| EP | 0 259 017 A2 | 3/1988 |
| WO | WO 02/099189 A1 | 12/2002 |

OTHER PUBLICATIONS

International Preliminary Examination Report issued in PCT/FI02/00477.
International Search Report issued in PCT/FI02/00477.
Written Opinion issued in PCT/FI02/00477.
Reply to Written Opinion in PCT/FI02/00477.

* cited by examiner

*Primary Examiner*—John Kim
*Assistant Examiner*—Laura C Cole
(74) *Attorney, Agent, or Firm*—Stiennon & Stiennon

(57) ABSTRACT

Equipment and a method for changing a blade which is intended to be placed in a blade holder (10) and which is preferably arranged as a flexible band (16). The equipment has reels (14, 15) for keeping the band (16) reeled and transfer devices (18) for moving the band (16) in the blade holder (10) between the reels (14, 15). The equipment includes guide devices (17) for guiding the band (16) from a reel (14, 15) to the blade holder (10) and vice versa. The guide devices (17) are arranged to turn the band (16) longitudinally to be essentially parallel to the blade holder (10). The closest guide member (20) of the guide members (20, 20') belonging to the guide devices (17) is rotated to a position that essentially corresponds to the position of the blade holder (10) turned to the blade-changing position.

10 Claims, 5 Drawing Sheets

EQUIPMENT AND METHOD FOR CHANGING A BLADE

CROSS REFERENCES TO RELATED APPLICATIONS

This application is a National Stage Application of International Application PCT/FI02/00477, filed Jun. 4, 2002, and claims priority on Finnish Application No. 20015006, Filed Jun. 5, 2001.

STATEMENT AS TO RIGHTS TO INVENTIONS MADE UNDER FEDERALLY SPONSORED RESEARCH AND DEVELOPMENT

Not applicable.

BACKGROUND OF THE INVENTION

The present invention relates to equipment for changing a blade, which blade is intended for use in connection with doctoring or coating, and which is preferably arranged as a flexible band with one or several blades, the equipment including

- a first reel in connection with one end of the blade holder for storing the unused band reeled,
- a second reel in connection with the other end of the blade holder for storing the used band reeled,
- transfer devices for moving the band in the blade holder between the reels, and
- guide devices for guiding the band from the reel to the blade holder and/or from the blade holder to the reel, which guide devices are arranged to turn the band longitudinally to be essentially parallel to the blade holder.

Blades intended for doctoring and coating are used particularly in paper and board machines and in their finishing equipment. Conventionally, blades are changed manually. However, changing long blades is difficult and can even be dangerous. In addition, changing a blade is time consuming. This means that effective production time is reduced, while the blade changing also ties down workers.

Finnish patent number 103596 discloses equipment for changing a doctor blade, in which a band-like blade is fed from a reel to a blade holder and is then pulled from the blade holder onto a second reel. Thus, when changing blades, a band containing several blades can be fed simply with the aid of the operating devices. However, feeding the band by means of the changing equipment described is often difficult, because in reality there is generally little space around the doctor apparatus. The reels must then be located far away from the doctor apparatus, so that the band must be led using complicated guide devices. This makes the changing equipment less reliable and increases the purchase and operating costs of the changing equipment.

SUMMARY OF THE INVENTION

The invention is intended to create a new type of equipment, which is simpler and more reliable than previously and by means of which the drawbacks of the state of the art are avoided. The invention is also intended to create a new type of method for changing a blade, which can be applied simply in the various positions that utilize a blade. The use of the equipment according to the invention gives precise control over the blade, without creating peaks of stress that are detrimental to the blade. This is achieved with the aid of simple guide members, which are arranged to operate in stages. At the same time, the equipment is not only versatile, but also clear and reliable in operation. The equipment can be applied in different positions and with different kinds of blade. In the method according to the invention, the blade's natural properties are exploited, permitting the blade to be guided and fed rapidly and safely. The invention also allows a faster blade change than before to be achieved, as the entire production process is controlled in a new manner.

BRIEF DESCRIPTION OF THE DRAWINGS

In the following, the invention is examined in detail with reference to the accompanying drawings showing some embodiments of the invention.

DESCRIPTION OF THE PREFERRED EMBODIMENTS

Figure 1:
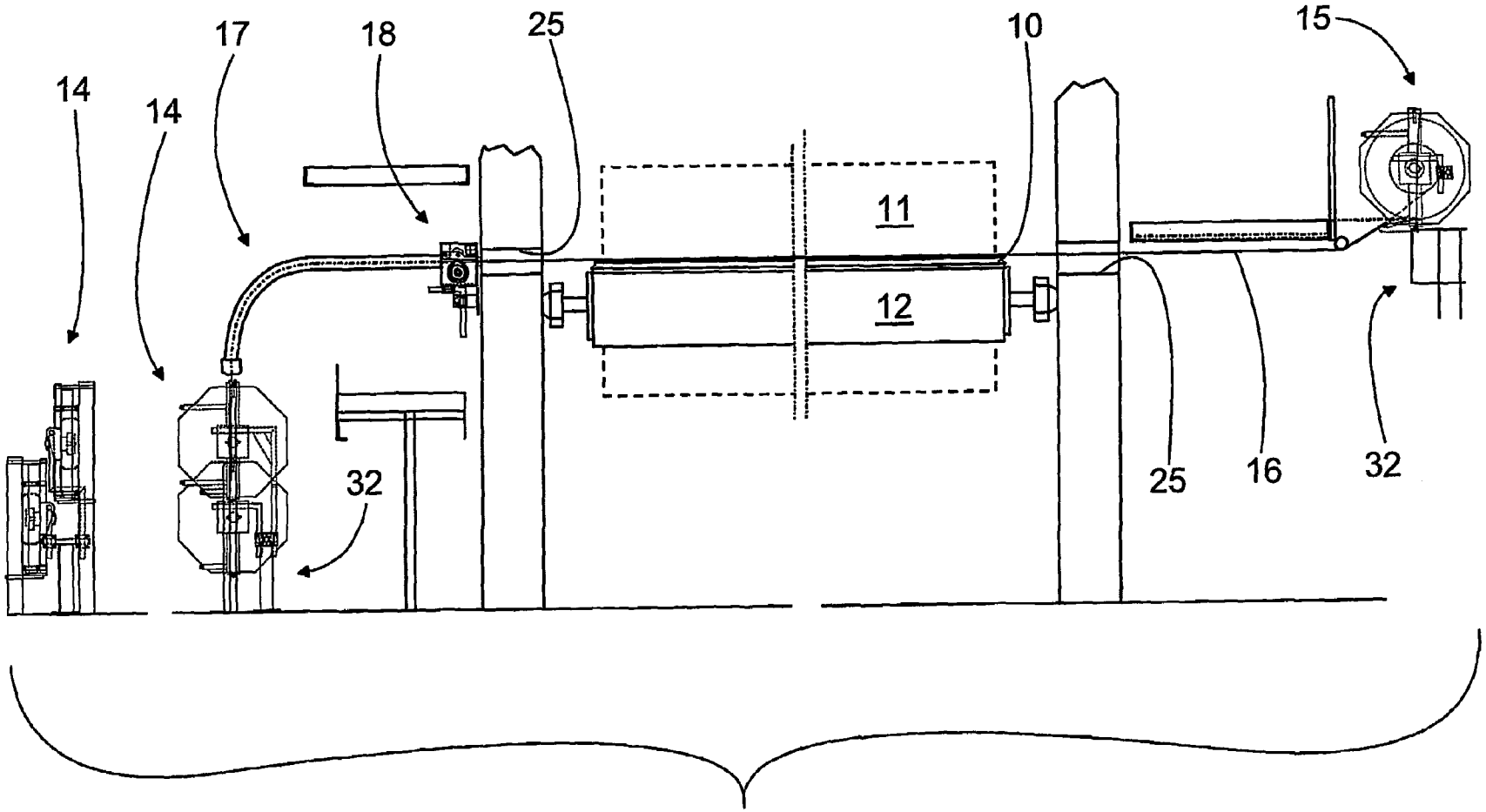
FIG. 1 shows the equipment according to the invention seen from the machine direction and partly seen from the side.
Figure 2:
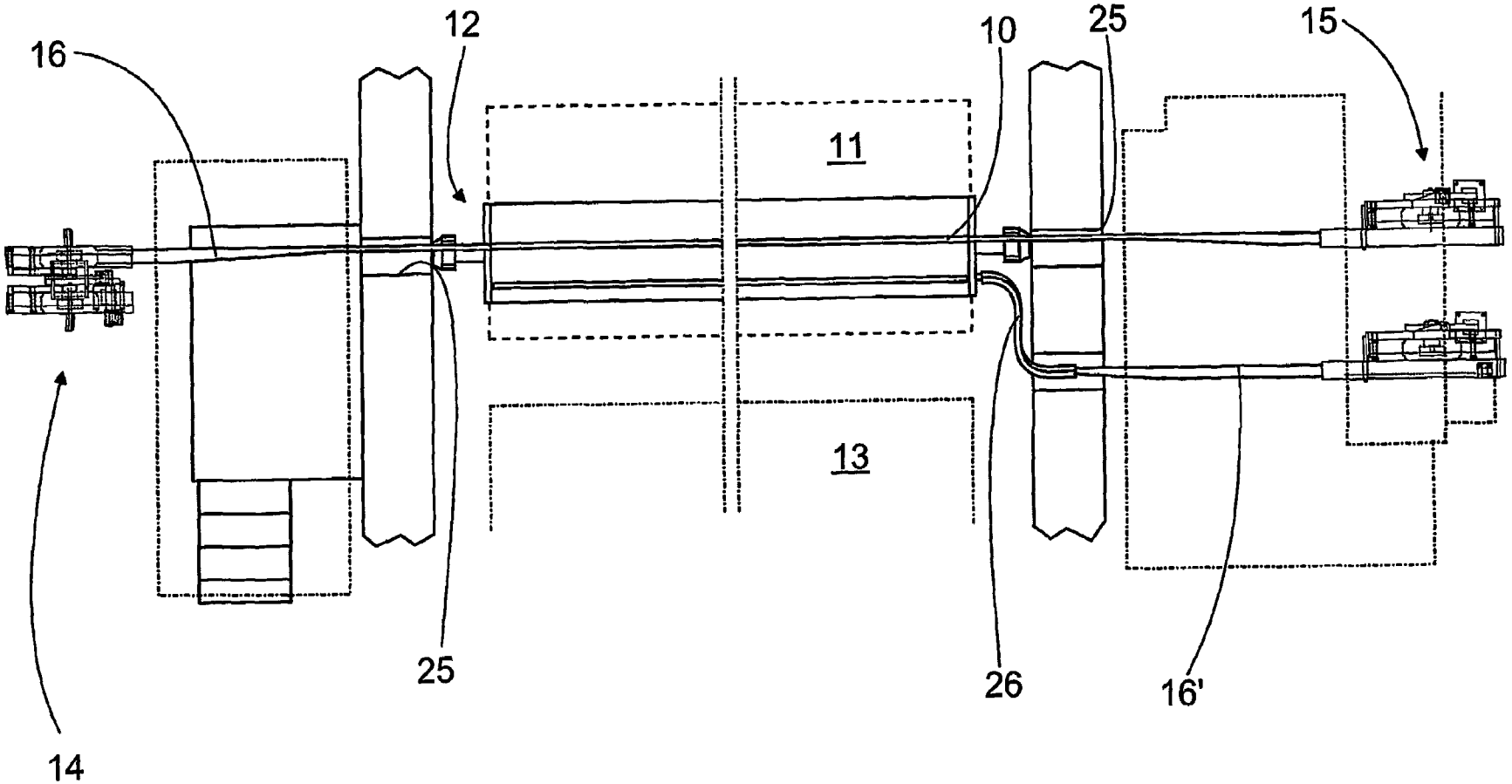
FIG. 2 shows a top view of the equipment of FIG. 1.

FIG. 1 shows the equipment according to the invention for changing a blade. In general, the blade is intended to be used in a blade holder 10, in connection with doctoring or coating. FIG. 1 shows the equipment installed in connection with the double doctor 12 of the center roll 11 of the press section of a paper machine. FIG. 2 also shows part of a drying cylinder 13 and the center roll 11 depicted by a broken line. In practice, there is a separate apparatus for each band, the operation of each of which can be controlled independently. In addition to blades intended for doctoring, the equipment can also be used to change, for example, coating and creping blades, depending on the position. To make blade changing faster, use is made of bands formed of one or several blades, which are, as such, known. The material of the band-like blades can also vary in different applications.

In order to change the flexible band-like blade, the equipment of the blade holder 10 includes two reels 14 and 15, according to FIGS. 1 and 2. The first reel 14, on which the unused band 16 is stored reeled, is connected to one end of the blade holder 10. Correspondingly, the second reel 15, on which the used band 16 is stored reeled, is connected to the other end of the blade holder 10. Independent of its use, the band is generally referred to in the drawings using the number 16. In addition, the equipment also includes transfer devices 18 for moving the band 16 in the blade holder 10 between the reels 14 and 15. The transfer devices include feed and pulling devices, such as those disclosed in FI patent 103596, for example. The first reel is preferably located on the tending side and the second on the drive side. This makes it easy to bring a reel containing a new band to the equipment. The used band can be removed from the drive side by changing the filled reel, but the band can also be transferred continuously back to the tending side. In this case, the drive side reel need not be changed. The location and changing of the reels is arranged to suit each operating situation. In FIGS. 1 and 2, the tending side is on the left and the drive side on the right.

The available reels are generally so large that they cannot be fitted right next to the blade holder. It is therefore necessary to place the reels in an otherwise suitable location further from the blade holder. In FIGS. 1 and 2, the tending side reels 14 are in a vertical position, essentially next to the blade holder 10. The band 16 is then led from the reel 14 to the blade holder 10, using the guide devices 17 that form part of the equipment. The drive side guide devices correspondingly lead the band 16 from the blade holder 10 to the reel 15, which is also in a vertical position. The guide devices are thus arranged to turn the band longitudinally essentially parallel to the blade holder, which allows the blade to be transferred to the blade holder.

Figure 3:
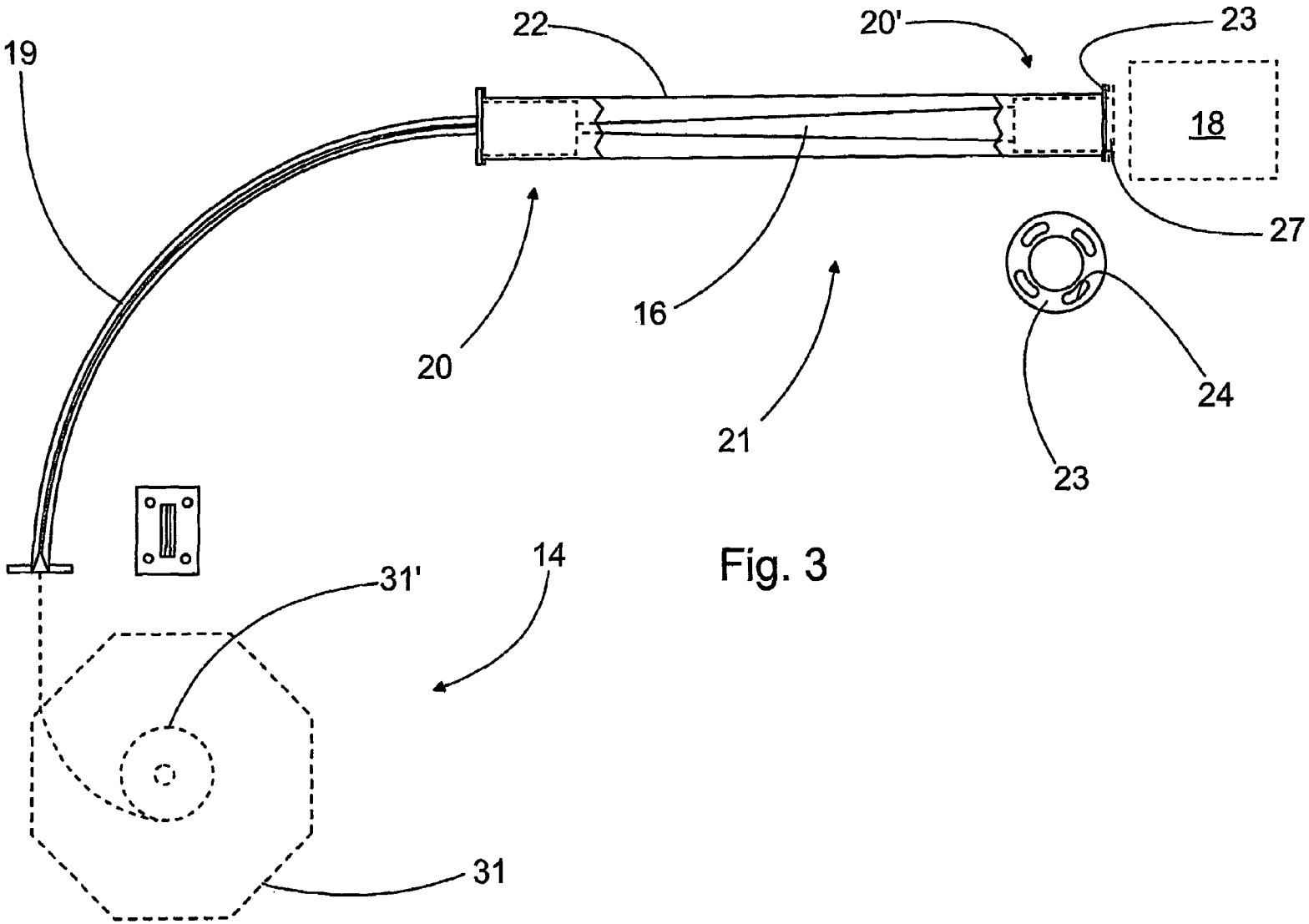
FIG. 3 shows part of the transfer and guide devices according to the invention in partial cross-section.

FIG. 3 shows guide devices according to the invention, to be fitted in connection with the end of the blade holder. First of all, the band 16 is turned longitudinally parallel to the blade holder using a guide 19, which is essentially closed. The start of the guide 19 is connected to the reel 14 and is shaped to correspond to the cross-section of the band. For reasons of clarity, the guide devices in FIG. 3 are shown separately from the other structures. The band 16 is supported in the guide 19 for the whole time, thus preventing the creation of local stress peaks. The guide is preferably of a plastic material, so that there is little friction. According to the invention, the guide devices also include guide members 20 and 20', which are set a short distance from each other and on the same line. In FIG. 3, the guide 19 is fitted to the first guide member 20. In addition, the band 16 is unsupported between the guide members 20 and 20', permitting the band 16 to rotate freely. This is imperative as the guide member 20' closest to the blade holder is in a position that is rotated around the longitudinal axis of the band 16, which position essentially corresponds to the position of the blade holder when it is turned to the blade-changing position. Thus, the band, which has been turned longitudinally parallel to the blade holder and essentially led to its location, can be rotated to the alignment of the blade holder. Thus, the band has an unobstructed and flexible path over the entire distance of the equipment. Setting the guide members on the same line avoids the additional stresses arising from torsion.

The angle of the blade holder changes when it is moved from the blade-changing position to the operating position and when the blade wears. The stresses in the band caused by the change of angle can be avoided, for example, by using an edge-slotted band, according to FI patent 103596. The edge slotting also permits the blade holder to oscillate while the band in the rest of the equipment remains stationary.

Figure 5:
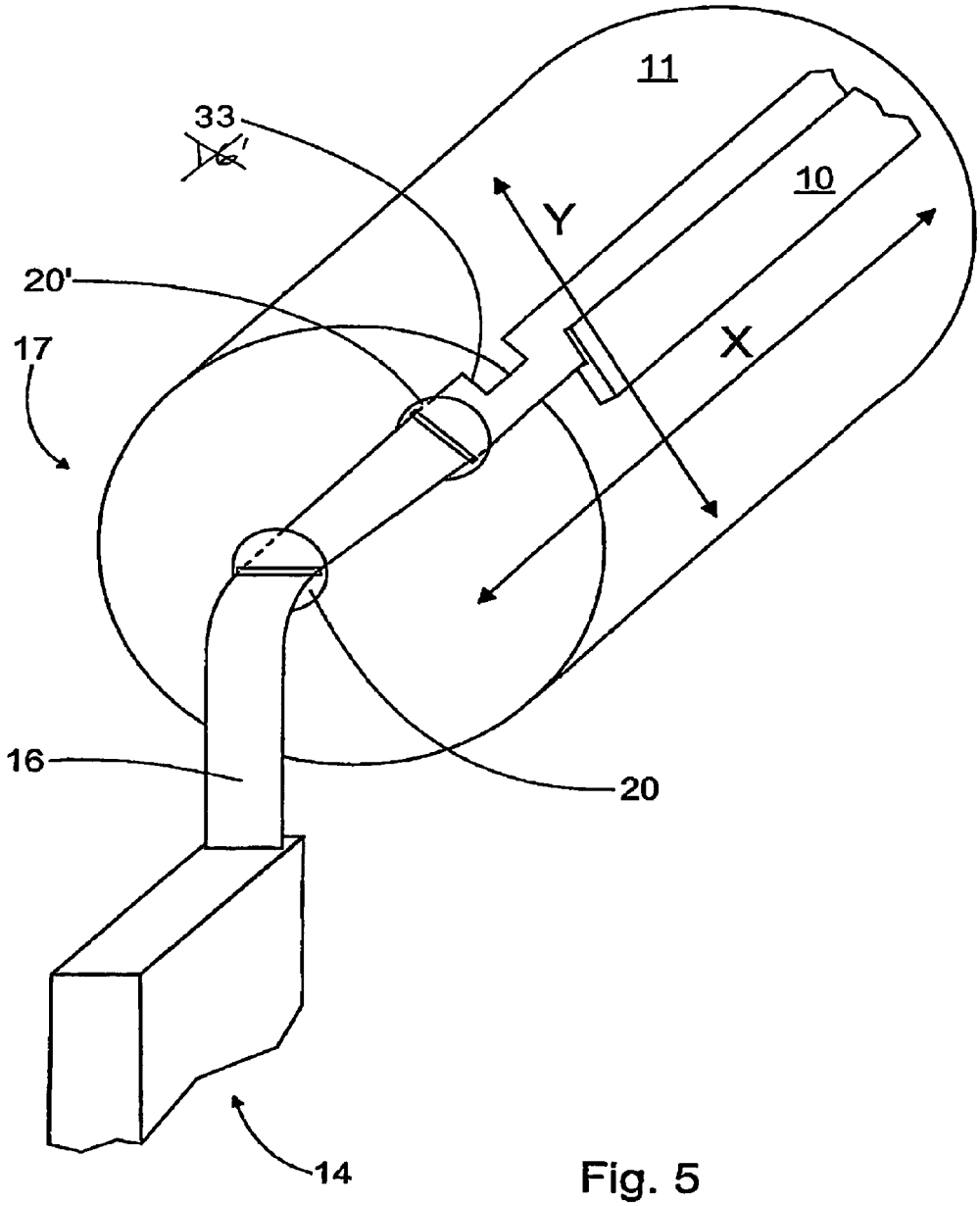
FIG. 5 shows the equipment according to the invention as an axonometric schematic drawing.

FIG. 5 shows a schematic drawing of the equipment according to the invention. In this case, the blade holder 10 is depicted in the blade-changing position, in which it is turned away from the surface of the roll 11. As in this position the blade too is off the surface being doctored, not much energy is required to change the blade. During the blade change, the band 16 is fed from the reel 14 to the blade holder 10, through the guide devices 17. In the blade change, the entire blade is changed at one time, there being several blades in a single band 16. First of all, the band 16 is turned with the aid of the guide devices 17 longitudinally essentially parallel to the blade holder 10. This direction is shown by the arrow X in FIG. 5. According to the invention, the guide members 20 and 20' forming part of the guide devices 17 are used to also rotate the band 16 around its longitudinal axis. In addition, the guide member 20' closest to the blade holder 10 is unexpectedly arranged to rotate the band 16 to the direction of the blade holder that is turned to the blade-changing position. This direction is shown by the arrow Y in FIG. 5. The equipment can then be used to change the blade simply and reliably by moving the band. After the blade change, the blade holder 10 is pressed back towards the roll 11, when the blade comes against the surface to be doctored. The turning and loading is possible due to the edge slot 33 arranged in the band. At the edge slot 33, the band 16 again rotates around its longitudinal axis, permitting wear and even oscillation in the blade while retaining the settings of the guide devices unchanged.

The difference of the rotation angle of the consecutive guide devices in relation to the longitudinal line of the band is preferably 10°–80°, most preferably 20°–60°. The band can then be rotated by a suitable amount at a time. In addition, the farther guide member of the blade holder is usually arranged to guide the band essentially horizontally. Thus, the reel can be located vertically, which is advantageous in terms of the operation and usability of the reel. The band can be rotated, because it is unsupported between the guide members. In this case, the actual guide members are connected by a closed channel 21, thus also protecting the band 16. In principle, the guide members can be supported independently of each other in some other manner. However, it is preferable to use a channel, which has rigidity and a cross-section that is essentially that of a round tube 22, according to FIG. 3. The guide members 20 and 20' can then be easily attached securely and can be freely rotated.

FIG. 3 also shows the end of the tube 22 seen from the direction of the tube 22. The guide members 20 and 20' are shown by broken lines. In this case, there is a flange 23 at the end of tube 22, in which there are attachment holes 24 that permit a change in angle. Thus, the guide member 20' can be attached simply with bolted connections and can also rotate within the tube 22 to the desired angle. There is preferably also a corresponding flange at the other end of the tube 22, allowing the difference of angle between the guide members 20 and 20' to be adjusted precisely. The guide devices 17 are preferably attached directly to the transfer devices 18 and from there on through the pull-through opening 25 to the blade holder 10 (FIG. 1). In principle, the guide devices are the same on both the tending and the drive sides. As there is usually less installation space on the drive side than on the tending side, the shape of the guide devices may differ. In FIG. 3, the tube 22 is shown in partial cross-section, so that the rotation of the band 16 is clearly visible.

FIG. 2 also shows the construction of the drive side guide devices in greater detail. Due to the lack of space, the second band 16' is guided after the blade holder 10 by means of a special guide tube 26. The guide tube is made from plastic and creates a displacement in a single direction, after which there are guide members according to the invention (not shown). In other words, at the outer end of the guide tube the band is still parallel to the blade holder. The guide members are then used to turn the band once again to the horizontal direction and guide it to the reel. In FIG. 2, the second reel 15 could be installed right next to the blade holder 10, thus making the guide tube unnecessary in the position in question. The reel 15 in question is also shown in FIG. 1.

Figure 4:
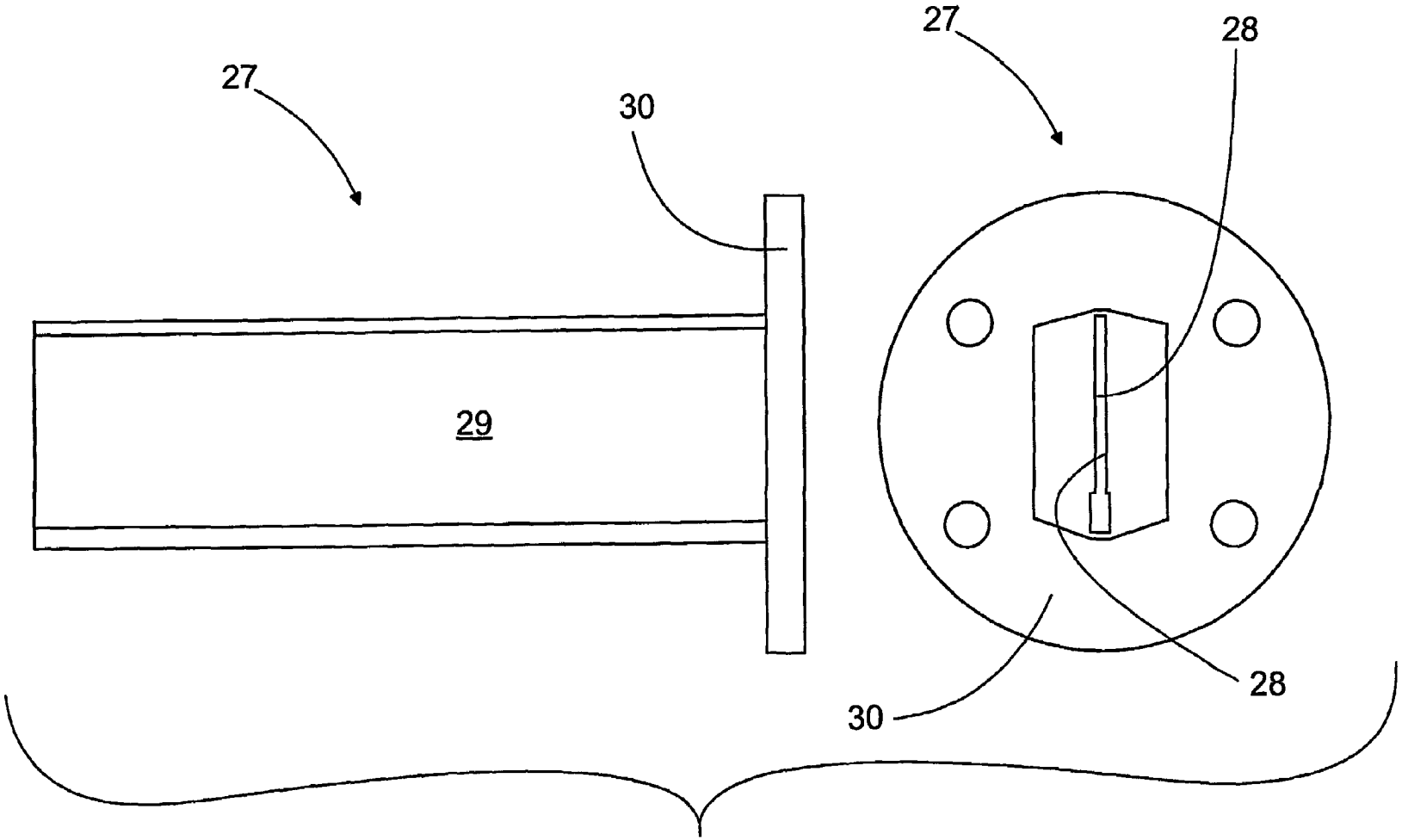
FIG. 4 shows side and front views of the guide member according to the invention.

The distance required to rotate the band varies mainly according to the dimensions and material of the band. Usually, the distance between the guide members is 4–16, preferably 8–12 times the width of the band. The stresses within the band will then remain within the permitted limits while the equipment remains advantageously small. In one set of equipment according to the invention, the distance between the guide members is about 700 mm. Operationally reliable and simple guiding is achieved by means of a nozzle, in which there is a flat support surface at least on two opposing sides of the band. Such a nozzle 27 forming a guide member 20 or 20' is shown in FIG. 4. Here, the nozzle 27 includes a body 29, which has support surfaces 28 shaped like the cross-section of the band. A flange 30 is also attached to the body 29, with the aid of which the nozzle 27 is secured to the flange 23 (FIG. 3) at the end of the tube 22. The nozzle is of a plastic material, preferably polyethylene or a similar plastic material. Plastic is highly durable in use, as the transfer speed of the band is low and the equipment operates in stages. In addition, there is little friction between the blade, which is made of a composite material, and polyethylene. The nozzle can be manufactured simply by extrusion. In addition, the closed construction of the equipment prevents the equipment and especially the band from being dirtied. On the other hand, band washing devices (not shown) can be located, for example, after the nozzle.

In the simplest form, there are two nozzles. In addition, the length of each nozzle is 1–6, preferably 2–4 times the width of the band. This means that the equipment is compact, but creates sufficient support for the band. As the friction is low, the support surfaces of the nozzle can be made wide. If necessary, several guides and guide members according to the invention can be joined in sequence. This is a significant advantage, particularly on the drive side. For example, the guide tube described above can be replaced with guide members and guides, in such a way that after the blade holder guide members are used to first of all rotate the band to the horizontal and then guides are used to turn it downwards. After this, guide members are once again used to rotate the band a second time, for example, through 90° and guides are again used to turn it to the machine direction. Thus the reel can still be set in a vertical position, but sideways in relation to the blade holder. By alternatively rotating the band and using guides or other means to turn it through a specific radius, the reel can if necessary be located at the side of the blade holder. The figures, however, show one of the most advantageous alternative embodiments.

The band is fed using transfer devices. The transfer devices are preferably fitted as close to the blade holder as possible. In the equipment according to the invention, hydraulic motors are used in the transfer devices. In addition, there are hydraulic motors in each reel, the operation and control of which are connected in parallel with the hydraulic motors of the transfer devices. In other words, when changing the blade, the band is moved using the transfer devices. At the same time, the hydraulic motor of the tending side reel can rotate freely and, when a sensor belonging to the equipment detects that the band has slackened, the hydraulic motor of the drive side reel begins to pull the band. This arrangement prevents the band from being broken and achieves a precise band transfer. Some other suitable power source can be used besides or instead of the hydraulic motors.

The reels 14 and 15 shown in the figures incorporate an octagonal casing 31, inside which there is a hub 31' that is supported so that it can rotate. The band 16 is reeled onto the hub 31', to which the hydraulic motor is connected. In the figures, each reel is supported on a separate support 32, but the entire equipment can be manufactured as a compact construction, which has a correspondingly shaped recess with the hydraulic motors. In that case, a new reel is simply placed in the recess, when the shape will lock the reel in place and the hydraulic motor will be connected to the hub of the reel.

According to the method according to the invention the guide devices are used to support the band, which has been rotated essentially parallel to the blade holder, from two points set at a distance to each other. Between these points, the band is rotated in relation to its longitudinal axis to a position essentially corresponding to the position of the blade holder when it is turned to the blade-changing position. When changing the blade, the transfer of the band is then unimpeded and the transfer requires little power, which in turn reduces the probability of the band being broken. FIG. 2 shows the rotation of one band 16 on both the tending and drive sides. The rotation of the second band 16' is shown only on the drive side. In order to illustrate this, FIG. 2 does not show the guide and transfer devices.

The method according to the invention can be advantageously used especially in a paper machine. The same advantage can also be achieved in board and similar web-forming machines. A paper machine comprises consecutive, operationally independent sections (not shown) equipped with doctoring apparatuses. If necessary, the web can be run down between sections. Such a situation occurs, for example, during a blade change or a web break. According to the invention, when a blade change is commenced, the web is run down from the section of the paper machine preceding the independent section of the paper machine in which the doctoring apparatus is located. Simultaneously, the said first section is run at production speed without the web. The use of the method in question achieves an important advantage especially in the paper machine's press section, in which the blade of the center roll's doctor apparatus, which preferably has two blades, is being changed. The web section is then run normally, but the web is run down into the pulper. At the same time, the blade holders of press section's doctor apparatuses are turned to the blade-changing position, while the press section continues to run at production speed, but without the web. The blade is changed using the equipment according to the invention. After the blade change, the blade holders are turned to the operating position and the web is guided onto the press section. This avoids stopping and restarting the press section, thus cutting the changing time to less than half of that known. This increases the effective production time of the paper machine, especially when using blades that wear rapidly.

The equipment according to the invention is very suitable for different kinds of positions and blades. The equipment can also be easily retrofitted, though the most suitable locations for the reels can be selected when designing a new machine. The equipment is light and safe to use, thanks to the remotely-controlled operating devices. The unimpeded transfer of the band and the small stresses imposed on the band are also important. Correspondingly, blade changing is considerably accelerated with the aid of the method according to the invention.

The invention claimed is:

1. Equipment for changing a flexible band forming a doctor blade, in a blade holder, the doctor blade for doctoring or coating a roll surface, comprising:

a blade holder having a first position for holding the doctor blade against the roll surface and a second position for accepting a blade change which is rotated from the first position so in the second position the doctor blade is not held against the roll surface;

a first reel having a flexible band reeled therein in supplying relation to a first end of the blade holder;

a second reel in receiving relation to a second end of the blade holder opposite of the first end, for reeling used flexible band;

a transfer device for moving the band between the first reel, the blade holder, and the second reel; and a plurality of guide devices for guiding the band from the first reel to the blade holder wherein the guide devices are arranged to turn the band longitudinally to be essentially parallel to the blade holder; and wherein each guide device has a first guide member distal from the blade holder and a second guide member proximal to the blade holder, the first guide member and the second guide member are alined along a line at a distance to each other, without band supports extending therebetween, and the second guide member closest to the blade holder is in a position rotated in relation to a longitudinal axis defined by the band, which essentially corresponds to a position defined by the blade holder turned to the blade-changing position, in which position the blade is off the roll surface doctored or coated, wherein the first guide member and the second guide member are connected by a closed channel.

2. The equipment of claim 1 wherein the first guide member and the second guide member are connected by a closed channel, which is a rigid tube with an essentially round cross-section.

3. Equipment for changing a flexible band forming a doctor blade, in a blade holder, the doctor blade for doctoring or coating a roll surface, comprising:

a blade holder having a first position for holding the doctor blade against the surface and a second position for accepting a blade change which is rotated from the first position so in the second position the doctor blade is not held against the roll surface;

a first reel having a flexible band reeled therein in supplying relation to a first end of the blade holder;

a second reel in receiving relation to a second end of the blade holder opposite of the first end, for reeling used flexible band;

a transfer device for moving the band between the first reel, the blade holder, and the second reel; and a plurality of guide devices for guiding the band from the first reel to the blade holder wherein the guide devices are arranged to turn the band longitudinally to be essentially parallel to the blade holder; and wherein each guide device has a first guide member distal from the blade holder and a second guide member proximal to the blade holder, the first guide member and the second guide member are alined along a line at a distance to each other, without band supports extending therebetween, and the second guide member closest to the blade holder is in a position rotated in relation to a longitudinal axis defined by the band, which essentially corresponds to a position defined by the blade holder turned to the blade-changing position, in which position the blade is off the roll surface doctored or coated, wherein the first guide member and the second guide member are nozzles, in which there is a flat support surface at least on two opposing sides of the band.

4. The equipment of claim 3, wherein the nozzle is of a plastic material, preferably polyethylene or a corresponding plastic material.

5. The equipment of claim 3, wherein the band has a width, and wherein the length of each nozzle is 1–6 times the width of the band.

6. The equipment of claim 3, wherein the band has a width, and wherein the length of each nozzle is 2–4 times the width of the band.

7. A method for changing an entire blade, in which method a flexible band formed of several blades is used in connection with doctoring or coating a surface, comprising the steps of:

turning a blade holder from a first position holding a first doctor blade against a surface being doctored or coated, to a blade-changing position in which position the first blade is off the surface being doctored or coated;

while the blade holder is in the blade-changing position, changing the blade by moving an entire second blade into the blade holder at one time using transfer devices and guide devices, in such a way that the guide devices are used to turn the band essentially parallel to the blade holder in the blade-changing position, the guide devices supporting the band at two points set on the same line at a distance to each other, between which the band is rotated to a position relative to its longitudinal axis that essentially corresponds to the position of the blade holder in the blade-changing position; and turning the blade holder to the first position holding the second blade against the surface being doctored or coated by utilizing at least two edge slots which make the blade more easily rotated in relation to a longitudinal axis defined by the band.

8. The method of claim 7 further comprising the steps of:

guiding the band using nozzles as the first and second guide members, wherein each nozzle has a flat support surface at least on two opposing sides of the band which supports and guides the band; and rotating the band with the nozzles to the position relative to its longitudinal axis that essentially corresponds to the position of the blade holder in the blade-changing position.

9. A method for changing an entire blade, in which method a flexible band formed of several blades is used in connection with doctoring or coating a roll surface, comprising the steps of:

turning a blade holder from a first position holding a doctor blade against a roll surface being doctored or coated, to a blade-changing position in which position the blade is off the roll surface being doctored or coated; and while the blade holder is in the blade-changing position, changing the entire blade by moving an entire blade into the blade holder at one time using transfer devices and guide devices, in such a way that the guide devices are used to turn the band essentially parallel to the blade holder in the blade-changing position, the guide devices supporting the band at two points set on the same line at a distance to each other, between which the band is rotated to a position relative to its longitudinal axis that essentially corresponds to the position of the blade holder in the blade-changing position, wherein the method is practiced on a paper machine which includes consecutive, operationally independent sections equipped with doctoring apparatuses, between which a web is run down if necessary, and further comprising the step of:

when the blade change is commenced, running down the web from a first independent section of the paper machine preceding a second section in which the doctoring apparatus is located, when the said second section is run at production speed without the paper web.

10. The method of claim 9 wherein the method is practiced on the paper machine having a press section with a center roll having a second doctor blade and a second blade holder, and further comprising the step of changing the second doctor blade.

* * * * *